US005463970A

United States Patent [19]

Hartlmeier et al.

[11] Patent Number: 5,463,970

[45] Date of Patent: Nov. 7, 1995

[54] FURLING FOIL FOR SAILING VESSEL

[75] Inventors: Greg W. Hartlmeier, Whitefish Bay; Olaf T. Harken, Pewaukee, both of Wis.

[73] Assignee: Harken, Inc., Pewaukee, Wis.

[21] Appl. No.: 402,919

[22] Filed: Mar. 13, 1995

[51] Int. Cl.[6] ..... B63H 9/04

[52] U.S. Cl. ..... 114/105; 114/108

[58] Field of Search ..... 114/102, 103, 114/39.1, 39.2, 50, 104, 105, 106, 108

[56] References Cited

U.S. PATENT DOCUMENTS

| | | | |
|---|---|---|---|
| Re. 31,829 | 2/1985 | Stern | 114/105 |
| 3,802,373 | 4/1974 | Lagerquist | 114/105 |
| 3,927,633 | 12/1975 | Bernard | 114/105 |
| 4,619,216 | 10/1986 | Crear, III et al. | 114/105 |
| 4,637,334 | 1/1987 | Montandon | 114/106 |

*Primary Examiner*—Stephen Avila
*Attorney, Agent, or Firm*—Juettner Pyle Lloyd & Piontek

[57] ABSTRACT

A furling foil rotatably mounted on a stay of a sailing vessel carries the forward edge of the sail, and the foil is rotated to furl the sail. The foil is of composite construction and has an inner reinforcing braided layer of high tensile filaments extending helically in both directions to substantially increase the torsion resistance of the foil while allowing the foil to be bent or coiled along its length for easy transportation and storage.

20 Claims, 3 Drawing Sheets

FURLING FOIL FOR SAILING VESSEL

BACKGROUND OF THE INVENTION

Sail furling devices are widely employed on sailing vessels to enable complete or partial furling and unfurling of a foresail, in which the sail is rolled up around its leading edge or luff and around a stay. Many of these devices include an elongate rigid foil having an internal channel rotatably mounted around the stay and an external channel for receiving and supporting the luff of the sail.

Conventional furling gear usually includes an upper swivel arrangement connected to the upper end of the foil and a lower rotary drive means connected to the bottom of the foil, such as a line wrapped on a drive or an electric or hydraulic motor. The foil is rotated by the drive means to roll up and furl the sail. The foil can also rotate in the reverse direction, and unfurling is accomplished by pulling on the normal trimming sheet attached to the clew of the sail.

Various forms of foils for supporting a jib are known, as shown in U.S. Pat. Nos. 3,802,373, 4,619,216 and Re. 31,829. Such foils may include more than one sail receiving groove to allow a change of sails while the original sail remains hoisted. A furling foil comprising a one-piece structure of inner and outer extruded metal tubes is shown in U.S. Pat. No. 4,637,334.

Since a furling foil is very long in comparison with the cross-sectional dimensions, the amount of resistance to torsion during furling is a critical concern. Any excessive twisting of the foil around its longitudinal axis may cause uneven rolling up of the sail, resulting in distortions in the sail, or even permanent damage to the foil itself.

In order to obtain a high degree of torsional resistance in a furling foil, it is known to fabricate the foil from high strength rigid materials, such as extruded aluminum. Unfortunately, however, such foils in their finished elongated form are nonresilient along their length and are easily damaged or permanently bent out of shape if lateral bending forces are applied. As a consequence, such foils must be produced and shipped in short sections and cannot be produced, coiled and shipped in a single continuous piece. The foil sections must be later permanently secured together around the stay by the consumer or a professional fitter during installation of the furling gear, with the mast raised. The finished foil is easily damaged when struck by other objects, such as a spinnaker pole. Also, if the mast is lowered at a later time, such as when a sailboat is stored or placed on a trailer for transport, precautions must be taken to avoid permanent damage to the fragile foil. Removal and storage are especially troublesome since the foil must be removed from its protective position around the stay, and the foil is longer than the mast. Also, the foil tends to be weaker at the area of the joints.

While it would be highly desirable to provide a one-piece furling foil having high torsion resistance but still capable of being bent or coiled along its length in a recoverable fashion, no acceptable solution has been forthcoming. It is known from U.S. Pat. No. 4,821,664 to provide a furling foil composed entirely of a thermoplastic polymer, such as polyvinyl chloride. Such foils can be constructed in a diameter which allows some degree of lengthwise flexibility. A serious drawback is that such foils have low torsional resistance, and twists of more than one complete turn are specified for a normal furling operation. This may cause distortion of the sail in a partial furling operation. A second drawback is that these plastic foils can become permanently distorted or set in a twisted state in sunlight and heat.

Another proposal is found in U.S. Pat. No. 3,872,816. The foil comprises a chain formed of interlocking links to resist torsional forces imposed by the furling winding drum. In practice, however, such chains are bulky and heavy, and no provision can be made for supporting the luff of the sail in an external groove.

SUMMARY OF THE INVENTION

The furling foil of the present invention is of composite construction and comprises an elongate member having an inner elongate member, an intermediate reinforcing portion bonded to the inner member and an outer shaped portion having a longitudinal open groove. The intermediate reinforcing layer preferably comprises continuous bands or filaments which extend along the length of the foil helically in one or in both rotary directions in order to provide torsional support. The filaments, bands, or bundle of filaments may be braided or interwoven in a continuous interlocking fashion around the inner tube, and the outer structure of the foil may be extruded over the inner portions. The outer portion includes one or more open longitudinal channels for receiving and supporting the luff of a sail.

In one embodiment, the inner and outer portions of the foil may be composed of relatively flexible or elastic plastic materials to allow lengthwise bending without interference from the reinforcing layer. The intermediate layer prevents kinking and other permanent distortion and also provides a degree of memory and restoring force to an elongated condition. Under normal sailing conditions, for example, in winds of up to 20 knots, the foil will have very little twist and substantially less than one turn of twist when the sail is being furled, i.e., when maximum torsion is being applied to the furling foil. The inner portion is hollow to allow the foil to be rotatably mounted on a stay.

In another embodiment, the inner portion may comprise a solid flexible member such as a rope. Such embodiment may be used for attachment to and furling of larger sails which normally have unsupported luffs, such as gennakers, which normally cannot be furled, and must be raised or lowered by a halyard from the top of the mast.

The foil may be produced in continuous long portions and cut to final length for transportation and storage in coiled form. The intermediate reinforcing layer may be knitted around the thermoplastic inner core with the application of heat, in order to bond the components together and to provide a reinforced tubular preform. The outer thermoplastic portion may be extruded over the preform in a continuous fashion to provide a bond to the reinforcing layer. In the alternative, the inner and outer portions may be coextruded with the reinforcing portion.

The furling foil can be installed as a single piece and is thereafter easily removed and coiled or otherwise stored without risk of permanent damage. This is a particularly useful advantage when the mast is removed and the boat is transported or stored.

The furling foil of the present invention offers several additional advantages. The foil cannot be dented when struck by foreign objects, and since the foil is continuous, the torsional resistance is uniform along the length. In addition, the foil can be made lighter in weight in comparison to conventional metal foils.

DESCRIPTION OF THE PREFERRED EMBODIMENTS

Figure 1:
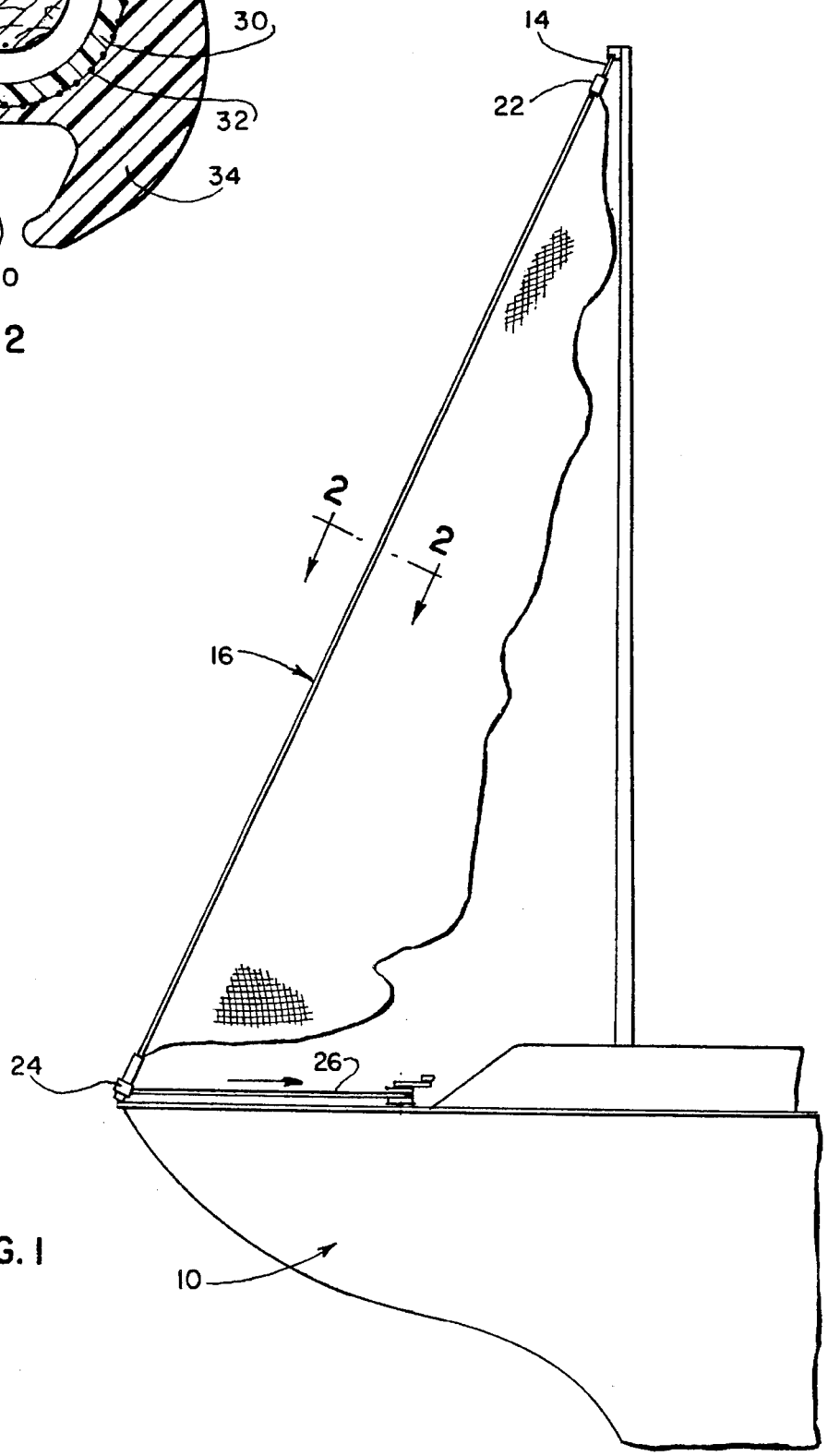
FIG. 1 is a side schematic view of a forward portion of a sailboat equipped with jib furling gear.

FIG. 1 shows essential elements of conventional jib furling gear. A sailboat 10 has an upright mast 12 supported forwardly by a forestay 14, which is a length of wire rope or rod connected between a top portion of the mast and the bow portion of a boat. Furling gear may also be employed to furl other types of sails, such as staysails, supported on stays located aft of the forestay, or for supporting free edges of sails, as described herein.

Figure 2:
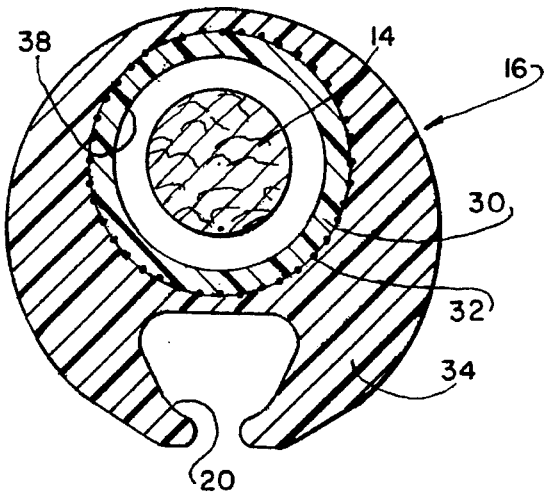
FIGS. 2 and. 3 are sectional views of two embodiments of the furling foil of the present invention, said views being taken perpendicular to the long axis of the foil.
Figure 3:
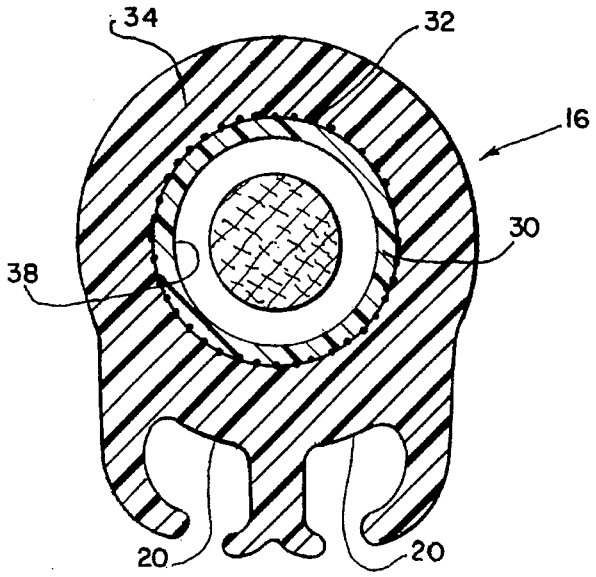

A furling foil 16 is disposed around the forestay 14 and extends substantially the entire length thereof. The furling foil carries the luff of a sail 18 in a conventional fashion. As shown in FIGS. 2 and 3, the foil has one or more longitudinal grooves 20 with restricted openings, with the luff of the sail having an elongated cross-sectional area or bead and being pulled up into the groove by a conventional halyard. The upper end of the foil 16 is connected to a swivel 22, and the lower end is connected to a rotary drive means, such as the illustrated drum or reel 24, which is rotated by pulling on an associated line 26 wrapped around the drum. This, in turn, causes rotation of the foil 16 around the stay 14 and the rolling up of the sail 18 around its forward edge or luff. The details of construction of numerous versions of furling gear of this nature are well known in the sailing industry.

The furling foil of the present invention is of composite construction. In the embodiments shown in FIGS. 2–6, the foil comprises an inner substantially flexible tube 30, an intermediate torsion resistant layer 32, and an outer cover portion or sheath 34 having one or more longitudinal grooves 20 or other sail attachment means therein. The inner 30 and outer 34 portions are bonded to the intermediate layer 32 to provide the composite elongated structure. The intermediate layer 32, while being highly torsionally resistant in combination with the other portions, is also flexible along its length. The intermediate layer 32 preferably comprises a plurality of reinforcing strands, bands or filaments extending in one or in two opposite helical or spiral directions around the length of the foil. These filaments, in compression and tension, oppose torsional forces exerted on the foil as a result of furling operations.

In the most preferred embodiment, the inner tube 30 is composed of a polymer and preferably a thermoplastic. In order to reduce friction between the stay 15 and the tube 30, the tube may be composed of a low friction material, including materials such as nylon, polyolefins, and preferably polypropylene.

Figure 5:
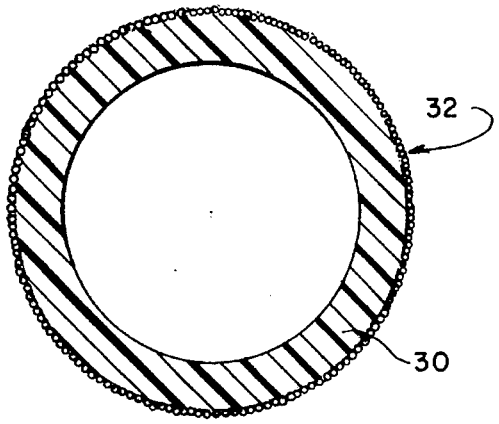
FIG. 5 is a sectional view through line 4—4 of the preform shown in FIG. 4.
Figure 4:
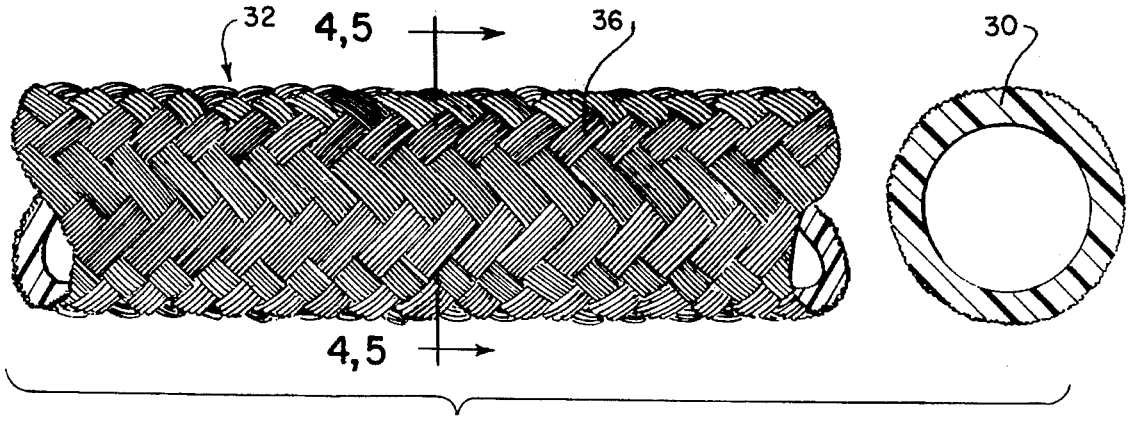
FIG. 4 is a top view of the foils shown in FIGS. 2 and 3, with the outer portion removed.

The intermediate, torque-resistant layer or sleeve 32 is then applied and bonded to the inner tube 30, as shown in FIGS. 4 and 5. The layer 32 preferably comprises high modulus filaments which are applied in a helical fashion in both rotary directions around the length of the tube. These filaments preferably comprise metal such as stainless steel, but may also comprise glass, boron, or other known filaments having high tensile strength and being flexible along their length, such as aramids.

As shown in FIG. 4, the filaments may be in the form of an interwoven fabric, with bundles of strands 36 in one helical direction overlapping and interwoven with bundles in the other direction in a continuous fashion. The fabric may be in the form of a braided or interwoven tube or sleeve heat welded to the inner tube.

In the preferred embodiment, the wire is continuously braided directly around the inner tube while the wire is being heated, such as by induction heating, which causes the braided tube to fuse and permanently bond with the inner tube upon cooling. While a separate adhesive could be employed, the direct bonding is more efficient.

After the inner reinforced tube has been prepared, as shown in FIGS. 4 and 5, the outer sheath 34 is applied. The sheath 34 may be profiled to reduce wind resistance and comprises an elongate inner cylindrical wall bonded to the outwardly facing surface of the intermediate layer 32, and having one or more external longitudinal grooves or channels 20 in a relatively thick portion of the sheath. The channels 20 have restricted openings to receive the luff of a sail in a conventional fashion.

While the sheath 34 may be made separately and bonded to the inner portions by adhesive, it is preferable to extrude the sheath directly over the inner portion by a coextrusion process, using a die of suitable configuration, through which the inner portion and molten thermoplastic are coextruded. The sheath is preferably composed of a relatively hard and somewhat flexible thermoplastic material having good resistance to the sun and oxidation, such as polyvinyl chloride. Upon extrusion, the hot thermoplastic penetrates the intermediate layer 32 and upon cooling forms a permanent bond therewith. Another possible method of production is to pultrude or coextrude the reinforcing layer with the inner and outer portions.

Figure 6:
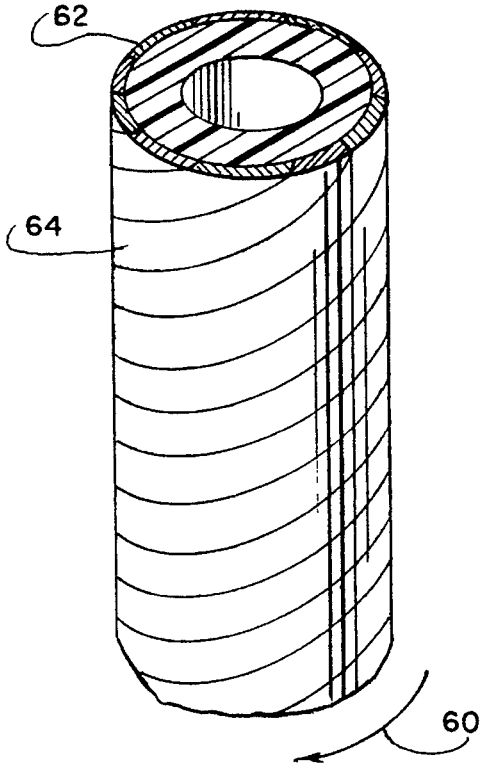
FIG. 6 is a side view of the inner portion of another embodiment of the present invention.

Another embodiment is shown in FIG. 6. Since furling imposes torsion on the foil in only one direction, as indicated by the arrow at 60, the torque resisting portion may be unidirectional as opposed to bidirectional in the previous embodiments. FIG. 6 shows an inner plastic tube 62 having a single continuous band 64 of reinforcing material, such as a metal strip, applied around the tube in a helical fashion. When torsional force is applied in the direction of the arrow (60), the band tends to compress around the central core and provide torsional resistance. A second strip can be applied in the opposite direction.

The use of a helical or spiral reinforcing layer has the advantage that the layer is very flexible lengthwise but provides substantial torque resistance. The pitch of the reinforcing layer may be decreased for added torsional resistance, or increased where less resistance is needed. As a specific example, for a foil having an approximate length of 31 feet, a stainless steel braid may be employed in which the braid comprises twenty-four bundles of wire, with eight wires in each bundle, and being braided at a 1.56 inch pitch. This results in a foil having less than one revolution of twist in maximum wind conditions.

In addition, the pitch of the reinforcing layer may be varied over the length of the foil. The lower portion of the foil is subjected to the highest torque, and this portion may include a reinforcing layer with a lower pitch, or an extra layer.

Figure 7:
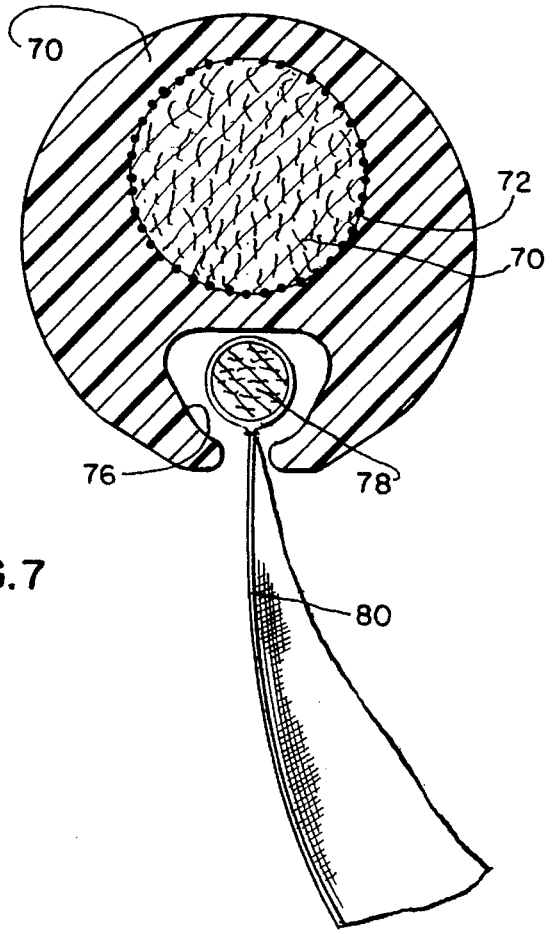
FIG. 7 is a sectional view of another embodiment for directly supporting and furling the free edge of a sail.

FIG. 7 shows another embodiment in which a stay is not employed, and a free edge of a sail is carried directly by the foil. Sails such as gennakers or cruising spinnakers are flown with unsupported edges and there is no stay to support the foil or the leading edge of the sail. Hence, it is not possible to partially furl these sails by roller furling.

As shown in FIG. 7, the central portion f the foil may comprise a flexible line or rope 70, preferably made from high tensile strength material such as aramid. The spiral reinforcing layer 72 is bonded t the core 70, and the outer sheath 74 is disposed around the reinforcing layer as in the previous embodiments. The sheath 74 has a longitudinal channel 76 to receive a bead 78 on the edge of a sail 80.

The foil shown in FIG. 7 would be relatively small in diameter in comparison to forestay foils, but the foil would be rotated in the same manner for furling, such as by use of a small furling drum. A distinct advantage is that such sails may be partially or completely furled without the need to lower the sail.

The resulting product has properties which are unique and highly superior to known furling foils. The foil can be bent along its length in a direction away from the grooved portion into the form of a coil. The foil does not kink during bending because the intermediate layer resists radial expansion and contraction around the inner portion and also helps to restore the foil to its straight configuration. At the same time, the elongated foil has a high torque resisting moment and is highly resistant to torque or twisting forces around the longitudinal axis, comparable to an extruded aluminum foil of the same length and overall diameter. The cross-sectional dimensions of the foil may be easily designed to accommodate foils of various lengths and working loads. The foil is comparatively light in weight, and the outer plastic sheath and groove are not subject to damage or denting.

What is claimed is:

1. A furling foil for furling a sail around its luff and around a stay of a sailing vessel, said furling foil comprising an elongate member, said member comprising an outer flexible portion of a first material having a longitudinal groove therein for supporting the luff of a sail, and an inner reinforcing portion of a second different material bonded to said outer portion, said inner portion having substantially greater torsional resistance than said outer portion, said furling foil being substantially bendable along its length without permanent distortion.

2. The furling foil of claim 1 wherein said inner reinforcing portion comprises a continuous filament extending helically within said elongate member.

3. The furling foil of claim 1 wherein said first material is a thermoplastic.

4. A furling system for a sailing vessel comprising a stay on said sailing vessel, a furling foil rotatably mounted on said stay, and a sail having its forward edge supported by said furling foil, said furling foil comprising an inner elongate tube, an outer portion coextensive with said inner tube, means in said outer portion for supporting said sail, and reinforcing means bonded between said inner tube and outer portion for substantially increasing the torsional resistance of said furling foil.

5. The furling system of claim 4 wherein said reinforcing means comprises a plurality of filaments extending around said inner tube in a helical fashion.

6. The furling system of claim 4 wherein said reinforcing means comprises a helical metal band.

7. The furling system of claim 5 wherein said plurality of filaments extend in two opposite helical directions around said inner tube.

8. The furling system of claim 3 wherein said plurality of filaments are braided around said inner tube.

9. The furling system of claim 8 wherein said plurality of filaments comprise metal filaments.

10. The furling system of claim 9 wherein said inner elongate tube comprises a thermoplastic material and said plurality of filaments are heat bonded to said inner tube.

11. The furling system of claim 4 wherein said outer portion comprises a thermoplastic material extruded over said reinforcing means.

12. The furling system of claim 4 wherein means are connected to said furling foil for rotation thereof.

13. In a furling system for a sailboat wherein said furling system comprises a stay, an elongate improved furling foil having a central channel extending around a stay, external means on said furling foil for supporting the edge of a sail, and means for rotating said furling foil around said stay, wherein said furling foil comprises an inner portion having said central channel and an outer portion having said external means, said inner and outer portions comprising flexible plastic materials, and an intermediate reinforcing portion bonded between said inner and outer portions, said intermediate portion providing a substantial increase in torsional resistance of said furling foil while allowing said foil to be bent lengthwise in the form of a coil without permanent distortion.

14. The furling system of claim 13 wherein said inner portion is composed of polypropylene.

15. The furling system of claim 13 wherein said outer portion comprises a thermoplastic extruded polymer.

16. The furling system of claim 13 wherein said intermediate reinforcing portion comprises high tensile braided filaments.

17. The furling system of claim 16 wherein said filaments are steel wire.

18. A furling foil for furling a sail around an edge of the sail, said furling foil comprising an elongate inner flexible member, a torsion resistant layer disposed around at least a portion of said elongate inner member, said torsion resistant layer being longitudinally flexible, an outer flexible portion disposed around said torsion resistant layer, and a longitudinal groove means for receiving and supporting the edge of a sail.

19. The furling foil of claim 18 wherein said torsion resistant layer comprises helical windings.

20. The furling foil of claim 18 wherein said inner flexible member comprises a rope.

* * * * *